US005821177A

United States Patent [19]

Elgarhy

[11] Patent Number: 5,821,177

[45] Date of Patent: Oct. 13, 1998

[54] ENHANCEMENT OF STAIN RESISTANCE OR ACID DYE FIXATION, IMPROVED LIGHT FASTNESS AND DURABILITY OF FIBROUS POOLYAMIDE AND WOOL SUBSTRATES

[75] Inventor: Yassin M. Elgarhy, Laval, Canada

[73] Assignee: Trichromatic Carpet Inc., St-Eustache, Canada

[21] Appl. No.: 766,101

[22] Filed: Dec. 16, 1996

[51] Int. Cl.[6] ..... B05D 3/02

[52] U.S. Cl. ..... 442/93; 442/152; 442/168; 427/389; 427/393.4; 252/8.62

[58] Field of Search ..... 442/93, 168, 152; 427/389, 393.4; 252/8.62

[56] References Cited

U.S. PATENT DOCUMENTS

| | | | |
|---|---|---|---|
| 4,592,940 | 6/1986 | Blyth . | |
| 4,780,099 | 10/1988 | Greschler et al. | 8/115.6 |
| 4,822,373 | 4/1989 | Olson et al. . | |
| 4,937,123 | 6/1990 | Chang et al. . | |
| 5,328,766 | 7/1994 | Smith . | |

OTHER PUBLICATIONS

American Dyestuffs Report, vol. 25, No. 11, Nov. 1993, Huang et al of the Textile Research Institute, Princeton, New Jersey, U.S.A.

*Primary Examiner*—Christopher Raimund
*Attorney, Agent, or Firm*—Swabey Ogilvy Renault

[57] ABSTRACT

A mixture of at least one acid and at least one metal compound enhance the stain resistance or acid dye fixation and resistance to cold water bleeding of fibrous polyamide and wool substrates, for example, carpets, treated with a water-soluble sulfonated aromatic-aldehyde condensation resin, for example, sulfonated resole and sulfonated novolak type resins; at the same time an improvement in light fastness or non-yellowing is obtained and the durability or wash fastness of the stain resistance is improved; the condensation resin is optionally employed in conjunction with a polymeric methacrylic acid. The acid of the mixture is one or more of phosphoric acid, polyphosphoric acid, citric acid and sulfuric acid; the metal compound is, in particular, a salt of magnesium or copper.

20 Claims, No Drawings

ENHANCEMENT OF STAIN RESISTANCE OR ACID DYE FIXATION, IMPROVED LIGHT FASTNESS AND DURABILITY OF FIBROUS POOLYAMIDE AND WOOL SUBSTRATES

BACKGROUND OF THE INVENTION i) Field of the Invention

This invention relates to a fibrous substrate, more especially a polyamide or wool substrate having stain resistance or enhanced fixation of acid dyes, light fastness and wash fastness; to a process for imparting stain resistance or enhanced fixation of acid dyes, light fastness and wash fastness to such a fibrous substrate; to a formulation for enhancing stain resistance or fixation of acid dyes, light fastness and wash fastness of such a fibrous substrate.

ii) Description of Prior Art

Fibrous polyamides and wool are employed in the manufacture of textile products such as carpets which are dyed in a variety of colours or in a pattern defined by colours. Polyamides, notably nylons are in particular widely employed in carpet manufacture.

Such products are frequently exposed to staining by natural and artificial colourants which are commonly found in many foods and beverages.

A number of treatments are available to provide stain resistance in such textile products, for example, carpets, so that the products are resistant to staining by such colourants.

The most efficient stain resisting agents known are resins, in particular, novolak resins, resol resins and condensation products of formaldehyde with dihydroxydiphenyl sulfone and naphthalene sulfonic acid.

A major problem with these resins is that when they are used alone as a stain resist, they have a reverse effect on the light fastness and cause yellowing problems on the treated fibers. Much research has been done in an attempt to overcome this problem.

It has been proposed to reduce the amount of dihydroxydiphenolsulfone and increase the amount of phenol sulfonic acid or naphthalene sulfonic acid, however, the improvement in the yellowing problem and the light fastness was not significant. The addition of products having a high resistance to oxidation or light, to the stain resist has also been proposed but this improved only slightly the yellowing problem and the light fastness.

It has been proposed to reduce the amount of phenolic resins and replace them with other stain blockers, for example, polymeric methacrylic acid resins, which improved the light fastness and also solved to a great extent the yellowing problem. The disadvantage with these products is the poor wash fastness because the polymeric methacrylic acid resins have poor wash fastness and the low amount of phenolic resin in the product is not sufficient to provide acceptable wash fastness, and light fastness, at the same time.

It has also been proposed to use a small amount of magnesium sulfate with the stain blocker in the same bath, this did not improve the light fastness at all, but slightly improved the exhaustion of the stain blocker and did not have any effect on the wash fastness or the durability of the carpet to shampooing.

The most popular acid used for application with stain blockers is sulfamic acid because it is a strong acid and economical, however, it causes noticeable yellowing of polyamide fibers. Some manufacturers have employed citric acid which produces a better quality and does not cause yellowing of the polyamide fibers, but this is expensive, especially if the pH required is under 2.5 where larger quantities of this acid are required.

There remains a need to provide stain resistance in conjunction with light fastness and wash fastness on polyamide and wool substrates, such as carpet.

Thus, U.S. Pat. No. 4,592,940 describes the use of a condensation product of formaldehyde, dihydroxy diphenylsulfone and phenosulfonic acid to provide stain resistance on nylon carpets. U.S. Pat. No. 4,501,591 describes a process for continuously dyeing polyamide carpets in which stain resistance is imparted to the carpet during the dyeing by adding an alkali metal silicate and a sulfonated phenol-formaldehyde condensation product to the dye liquor used in the dyeing.

U.S. Pat. No. 5,328,766 describes the use of a combination of a partially sulfonated novolak resin and a soluble aluminum salt optionally with a methacrylate polymer to impart stain resistance, light fastness and durability to alkaline wash, to fibrous polyamide and wool substrates.

U.S. Pat. No. 4,822,373 describes the use of a partially sulfonated novolak resin and homopolymers or copolymers of methacrylic acid, to provide resistance to staining by acid colourants in fibrous polyamide materials.

U.S. Pat. No. 4,937,123 describes the use of homopolymers or copolymers of methacrylic acid to provide stain resistance to acid colourants in fibrous polyamide materials.

The problem of the yellowing and loss of stain resistance in nylon carpets treated with sulfonated phenol or naphthol condensates with aldehydes is described in American Dyestuffs Report, Vol. 25, No. 11, November 1993, by X. X. Huang et al of The Textile Research Institute, Princeton, N.J., U.S.A.

Canadian Patent 1,258,365 describes a low pH liquid buffer obtained by a combination of phosphoric acid and sodium phosphate monobasic.

U.S. Pat. No. 5,328,766 describes the use of aluminum sulfate as a catalyst with a stain blocker.

SUMMARY OF THE INVENTION

It is an object of this invention to provide a fibrous polyamide or wool substrate having improved characteristics of stain resistance, light fastness and wash fastness.

It is a further object of this invention to provide a process for imparting stain resistance, light fastness and wash fastness to a fibrous polyamide or wool substrate.

It is yet another object of this invention to provide a formulation for enhancing stain resistance, light fastness and wash fastness.

In accordance with one aspect of the invention there is provided a fibrous substrate having improved stain resistance, light and wash fastness comprising a fibrous polyamide or wool substrate bearing a formulation comprising:

i) a water soluble sulfonated aromatic aldehyde condensation resin, a hydrolyzed aromatic-containing vinyl ether maleic anhydride copolymer or a half ester of an aromatic-containing vinyl ether maleic anhydride copolymer, ii) a mixture of an acid selected from the group consisting of citric acid, sulfuric acid, phosphoric acid and polyphosphoric acid and at least one metal compound selected from the group consisting of magnesium salts, magnesium hydroxide, magnesium oxide copper salts, copper hydroxide, copper oxide, aluminum salts, aluminum hydroxide and aluminum oxide.

In accordance with another aspect of the invention there is provided a process for imparting stain resistance, light and wash fastness to a fibrous substrate comprising:

a) contacting a fibrous polyamide or wool substrate with an aqueous vehicle or medium containing:

i) a water soluble sulfonated aromatic aldehyde condensation product, a hydrolyzed aromatic-containing vinyl ether maleic anhydride copolymer or a half ester of an aromatic-containing vinyl ether maleic anhydride copolymer;

ii) a mixture of an acid selected from the group consisting of citric acid, sulfuric acid, phosphoric acid and polyphosphoric acid and at least one metal compound selected from the group consisting of magnesium salts, magnesium hydroxide, magnesium oxide, copper salts, copper hydroxide, copper oxide, aluminum salts, aluminum hydroxide and aluminum oxide;

b) allowing components i) and ii) to transfer from said aqueous vehicle or medium to said substrate; and c) drying said substrate.

DESCRIPTION OF PREFERRED EMBODIMENTS

In accordance with the invention there is employed a sulfonated aromatic-aldehyde condensation resin, a hydrolyzed aromatic-containing vinyl ether maleic anhydride copolymer or a half ester of an aromatic-containing vinyl ether maleic anhydride copolymer in conjunction with a mixture of one or more of phosphoric acid, polyphosphoric acid, citric acid and sulfuric acid; and one or more of the metal compounds identified hereinbefore.

In particular embodiments there may additionally be employed a polymeric methacrylic acid, namely, a homopolymer or copolymer of methacrylic acid.

i) Sulfonated Aromatic-Aldehyde Condensation Resin

The condensation product or resin may be a sulfonated resol resin, a sulfonated novolak resin or a condensation product of an aldehyde with dihydroxydiphenyl sulfone and naphthalene sulfonic acid.

In these condensation products or resins, the aldehyde is, in particular a lower aliphatic aldehyde, for example, formaldehyde or acetaldehyde, usually formaldehyde.

The sulfonated resol resin may be produced as the sulfonated condensation product of at least one phenol and at least one aliphatic aldehyde, the condensation being carried out at a pH higher than 7.

Suitable sulfonated resol resins are produced by condensing formaldehyde and phenol in alkaline media at pH of about 9 for about 60 minutes, at about 90° to 110° C., followed by approximately 40% sulfonation of the phenol formaldehyde condensation product with sodium metabisulfite at a pH between 4 and 6 at 90° to 110° C. for about 60 to 90 minutes followed by neutralizing and maintaining at acid pH after the treatment.

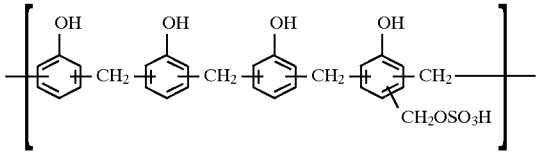

-continued

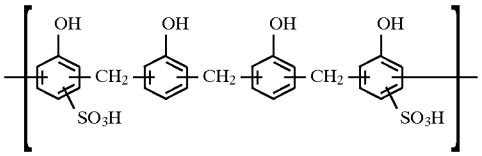

It will be understood that the degree of sulfonation may be varied but will generally be 30 to 50%, preferably 40%.

Suitably sulfonated novolak resins include but are not limited to condensation products of formaldehyde with bis(hydroxyphenyl)sulfone and phenol sulfonic acid.

The mole ratio of the bis(hydroxyphenyl)sulfone and the phenol sulfonic acid is generally 30 to 50:70 to 50, for example, 50:50, preferably 40:60 and more preferably 30:70.

A typical sulfonated novolak resin is a condensation product of phenolsulfonic acid and dihydroxydiphenyl sulfone with formaldehyde having a repeating unit as illustrated below:

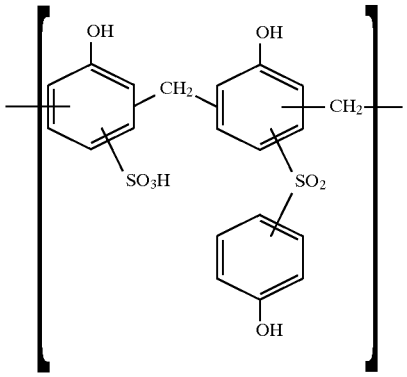

A suitable condensation product of an aldehyde with dihydroxydiphenylsulfone and naphthalene sulfonic acid, is one in which the aldehyde is formaldehyde.

The mole ratio of the dihydroxydiphenylsulfone to the naphthalene sulfonic acid is suitably about 25 to 40:75 to 60, for example, 40:60, 50:50, preferably 30:70 and more preferably 25:75.

A typical condensation product of naphthalene sulfonic acid and dihydroxydiphenylsulfone with formaldehyde has a repeating unit illustrated below:

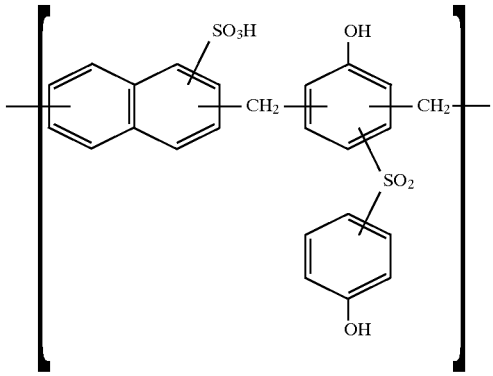

These condensation products are, in particular, water soluble and form aqueous solutions in water.

ii) Maleic Anhydride Copolymer Resin

A class of maleic anhydride copolymer resin useful in the invention comprises a copolymer selected from the group consisting of a hydrolyzed aromatic-containing vinyl ether maleic anhydride copolymer, a half ester of an aromatic-containing vinyl ether maleic anhydride copolymer, and mixtures thereof. By the hydrolyzed copolymer, or hydrolysis product, is meant the hydrolyzed copolymer in which some, preferably less than about 20 to 50 percent, of the original anhydride units remain as anhydride. By the half ester is meant the esterification product of the copolymer with a lower alcohol, preferably a $C_1$–$C_5$ alcohol, most preferably isopropyl alcohol, in which some, preferably about 25 to 50 percent, of the original anhydride units remain as anhydride and in which the reacted anhydride units are monoesterified. The copolymer has a weight average molecular weight between about 1,200 and 23,000 preferably between about 1,200 and 15,000, more preferably between about 2,000 and 10,000 and most preferably between about 2,000 and 4,000.

Particular copolymers include phenylvinylether/maleic diacid copolymer.

One suitable resin is that available under the Trade Mark SR400 of E. I. DuPont de Nemours.

iii) The Mixture of the Acid and Metal Compound

The sulfonated resin is employed in conjunction with a mixture of one or more acids selected from the group of phosphoric acid, citric acid or sulfuric acid, and at least one metal compound from Groups A, B and C below:

Group A):
Magnesium phosphate
Magnesium citrate
Magnesium lactate
Magnesium carbonate
Magnesium sulfate
Magnesium silico fluoride
Magnesium hydroxide
Magnesium oxide Group B):
Copper phosphate
Copper carbonate
Copper sulfate
Copper hydroxide
Copper lactate
Copper acetate
Copper silico fluoride
Copper hydroxide
Copper oxide Group C):
Aluminum silico fluoride
Aluminum potassium phosphate
Aluminum potassium sulfate
Aluminum magnesium sulfate
Aluminum magnesium phosphate
Aluminum sodium silicate
Aluminum lactate
Aluminum phosphate
Aluminum sulfate
Aluminum carbonate
Aluminum hydroxide
Aluminum oxide
Sodium aluminate This mixture or combination imparts a superior stain resistance to the fibrous polyamide or wool substrate when employed in conjunction with the sulfonated resin. The mixture of acid and metal compound is soluble in cold or hot water.

The metal compounds of Groups B) and C) are all salts and the compounds of Group A are salts with the exception of magnesium oxide and magnesium hydroxide.

The metal compound is employed in an amount of at least 0.1%, by weight, based on the weight of the acid and the metal compound. The acid is employed in an amount such that the formulation of resin, acid and metal compound in a vehicle such as water has a pH below 7, preferably 1.5 to 5 and more preferably 2 to 3.

iv) Polymers of Methacrylic Acid

In preferred embodiments, especially when the fibrous substrate is a polyamide substrate, the sulfonated resin and the mixture of acid and metal compound are employed in conjunction with a polymethacrylic acid, namely, methacrylic acid homopolymer or copolymers of methacrylic acid or combinations of methacrylic acid, homopolymer and copolymers of methacrylic acid.

In case of the copolymers; the comonomer may be a monocarboxylic acid, a polycarboxylic acid, an anhydride, an unsubstituted or substituted ester or amide of a carboxylic acid, an unsubstituted or substituted ester or amide of an anhydride, a nitrile, a vinyl monomer, a vinylidene monomer, a monoolefinic or polyolefinic monomer or a combination thereof.

Representative comonomers include alkyl acrylates wherein the alkyl group has 1 to 5, preferably 1 to 4 carbon atoms, itaconic acid, acrylic acid, styrene and sodium sulfostyrene. The copolymers may contain one or more comonomers for methacrylic acid.

Representative copolymers of methacrylic acid also include terpolymers of methacrylic acid, sodium sulfostyrene and styrene; methacrylic acid, and acrylic acid and methacrylic acid, acrylic acid and sulfated castor oil.

Preferably, the polymeric methacrylic acid comprise about 30 to 100 weight percent of the methacrylic acid. Homopolymers contain 100 weight percent of the methacrylic acid. Copolymers contain about 30 to less than 100, preferably 60 to 90 weight percent of methacrylic acid.

The weight average molecular weight and the number average molecular weight of the methacrylic polymer should be such that satisfactory stain resistance is provided by the polymer in combination with the sulfonated resin and the mixture of acid and metal compound. Generally, the lower 90 weight percent of the methacrylic acid homopolymer or copolymer has a number average molecular weight in the range of about 2,500 to 500,000.

v) Formulations

The active agents of the invention, namely sulfonated resin, the mixture of acid and metal compound, for example, salts and the optional polymeric methacrylic acid are employed together in a vehicle or medium for their application to the fibrous substrate. Preferably they are employed in an aqueous vehicle or medium.

The active agents may also be employed in a vehicle comprising a resist printing paste. In this way the resist printing paste may be employed to print a printed area on a polyamide or wool substrate, for example, a carpet, and the combination of active agents of the invention prevent staining of the printed area with acid dyes during dyeing.

The relative amounts of the resin, the mixture and the optional polymeric methacrylic acid in this invention should be sufficient to provide commercially acceptable stain resistance or light fastness and also wash fastness to fibrous polyamide or wool substrates, to the desired degree of durability and resistance.

Optimum amounts of the active agents will vary depending on the nature of the substrate.

In general an improvement in stain resistance, light fastness and durability or wash fastness is achieved when the water soluble sulfonated aromatic aldehyde condensation product is present on the substrate in an amount of at least 0.008, preferably at least 0.01, and more preferably at least 0.02 weight percent based on the weight of the substrate; and the mixture of acid and metal compound is present in an amount of at least 0.10, preferably at least 0.2 weight percent based on the weight of the substrate.

By way of example, when the substrate is nylon 66 and a sulfonated resol resin is employed, the resol resin is preferably in an amount of at least 0.008 weight percent, the amount of methacrylic acid polymer, if present, is at least about 0.06 weight percent; and the amount of acid and metal compound mixture is preferably at least about 0.1 weight percent, based on the weight of the substrate.

When the substrate is nylon 6 the amount of the sulfonated resol resin is suitably in an amount of at least 0.02, preferably at least 0.03 weight percent, the amount of methacrylic acid polymer, if present, is suitably at least 0.12 weight percent and the acid and metal compound mixture is suitably in an amount of at least 0.2 weight percent, based on the weight of substrate.

When the substrate is wool the sulfonated resol resin is suitably used in an amount of at least 0.02, preferably at least 0.03 weight percent and the amount of the acid and metal compound mixture is suitably at least 0.2, preferably at least 0.3 weight percent, based on the weight of the substrate; it is found that methacrylic acid polymers provide no significant improvement in the stain resistance of the wool substrates, in the present invention.

When using sulfonated novolak resin on nylon 66 substrate the amount of resin is preferably at least 0.01 weight percent, the amount of the methacrylic acid polymer, if employed, is about at least 0.06 weight percent, and the amount of the mixture of acid and metal compound is at least 0.10 weight percent, based on the weight of substrate.

When the substrate is nylon 6, the sulfonated novolak resin is suitably in an amount of at least 0.02 weight percent, the amount of the methacrylic acid polymer, if employed, is at least 0.12 weight percent, and the amount of the mixture of acid and metal compound is at least 0.02 weight percent, based on the weight of the substrate.

vi) Application

The treatment of the fibrous polyamide or wool substrate can be by different known methods to achieve higher stain resistance, durability or wash fastness and improved light fastness. The results may vary depending upon the method of application. Usually the stain resist can be applied to carpet by the following methods:

1. Exhaust method at a fiber to water ratio between 1:10 and 1:50, preferably between 1:10 and 1:30; the carpet is usually treated for between 20 to 30 minutes at 160° to 170° F., 2. Spray method in which the stain resist is sprayed in combination with fluorochemicals and other agents, for example, as soil release or soil resist agents or antistatic agents. In this case, the substrate usually contains between 30 to 50% humidity, and, the stain resist and the other additives are sprayed on the carpet, the carpet is dried and then cured without steaming.

3. Continuous Method

This can be carried out in two different techniques:

a) Pad with 200 to 400%, by weight, pick up, steam for 2 to 3 minutes, light rinse then normal dry.

b) The solution of the stain resist is passed through the carpet to improve the penetration with a pick-up between 200 and 400%, by weight, the carpet is steamed for about 3 minutes, followed by a light rinse and drying.

In all methods the solution of stain resist can be applied at cold or hot temperatures preferably hot.

vii) Substrate

The substrates employed in the invention are fibrous polyamide or wool substrates. The substrate may be in the form of fibers, yarns or fabrics; the invention has particular value for the case in which the substrate is a carpet, for example, household carpet, commercial and industrial carpet or automotive carpet.

The following Examples illustrate the invention employing stain resist and different formulations, combinations or acid and metal compound mixtures and other common products used in the industry.

EXAMPLES

The carpet samples used in this illustration are of untreated white nylon 6 or nylon 66. The first evaluation method was done by padding where the carpet sample was immersed in a solution of the stain resist at a pH 2. The pad pick-up on the carpet was 350%, by weight, of the untreated carpet. The carpet was steamed for 3 minutes at 110° C. or higher without any pressure, washed lightly, squeezed then dried.

The second evaluation method was done by the exhaust method in which the carpet sample was weighed, immersed in a solution of the stain resist with a fiber to water ratio of 1:20, the carpet sample was treated for 20 minutes at a temperature of 170° F. and at a pH of 2, the carpet sample was then rinsed, squeezed and dried.

Staining Test

The first staining test employs a staining test solution of the sweetened cherry soft drink KOOLAID (Trade Mark). The solution was made by diluting 10 g of KOOLAID in one liter of water. The treated carpet samples were stained with 20 g of the prepared test solution and kept for 16 hours at room temperature, then rinsed for evaluation. The samples were evaluated for staining on a graduated scale from 1 to 8 wherein 1 represents complete staining and 8 represents complete non-staining of the carpet; usually a stain resistance rating of 5 is considered acceptable, 7 is very good, 8 is excellent resistance to staining.

Light Test

The light test in this invention was made according to the light test method in the AATCC Test Book No. 1 GE 1978 for 40 hours under a xenon arc lamp. The sample exposed to ultraviolet light is evaluated for light fastness according to a graduated rating scale which ranges from 1 to 5 where rate 5 represents non-yellowing and 1 is very poor with severe yellowing, in general 4.5 is excellent and 4 is acceptable.

Wash Test

The wash test was carried out using 0.1 g/L anionic soap, the solution was adjusted to pH 10 with trisodium phosphate. The treated carpet sample was exposed to this solution for 5 minutes at 40° C., rinsed, dried and stained as mentioned above.

The sulfonated resins used to treat the carpet test samples were then as follows:

1. Sulfonated resol resin as described in this invention.

2. FX-661 (Trade Mark) a commercially available aqueous solution from Minnesota Mining Manufacturing Co., based on novolak resin and a methacrylic acid copolymer.

3. A resin formed by condensing formaldehyde with dihydroxydiphenyl sulfone and phenol sulfonic acid, the ratio of dihydroxydiphenyl sulfone to the phenol sulfonic acid is 30 to 70, the concentration, in weight %, of the novolak resin, the remainder being water, is 40%.

The methacrylic acid polymer used for evaluation has a weight average molecular weight of 6,000, the concentration, in weight %, in water, of the resin is 30%; the resin is available from Rohm & Haas under the Trade Mark LEUKOTAN 970.

Evaluation is then made by the stain test evaluation in which the stain is evaluated after washing on the scale of 1 to 8 as described for the staining test.

The additional agents used in the Examples were:

1) Product A which consists of:

65% Phosphoric Acid 85%
15% Magnesium Phosphate
5% Aluminum Potassium Phosphate
15% Water.

All the ingredients are added and the temperature of the mix is raised, the mix is stirred until the salt is completely dissolved.

2) Product B which consists of:

65% Phosphoric Acid 85%
15% Magnesium Phosphate
3% Copper Sulfate
17% Water.

The ingredients are mixed as for product A.

3) Magnesium sulfate.
4) Magna Flo II (Trade Mark of Sybron Chemical)
5) Tanacid PC (Trade Mark of Sybron Chemical)
6) Sulfamic Acid.
7) Product C which consists of:

24% Water
10% Aluminum Potassium Sulfate
20% Magnesium Sulfate
1.0% Copper Sulfate
5% Polyphosphoric Acid
40% Sulfuric Acid 66 B.

The above % are in weight %.

Table #1 shows the formulations of the invention and comparison formulations.

Table #2 shows the test results for the different formulations.

TABLE #1

| | | | | | | | | | | | | | Application on Nylon 6 | | |
|---|---|---|---|---|---|---|---|---|---|---|---|---|---|---|---|
| Formulations g/L | 1 | 2 | 3 | 4 | 5 | 6 | 7 | 8 | 9 | 10 | 11 | 12 | 13 | 14 | 15 |
| Sulfonated Resol Resin 60% | | | | | | | | | 1.1 | 1.1 | 1.1 | 1.1 | | | 1.1 |
| Methylmethacrylate copolymer 40000 mw 22% active | | | | | 10.5 | 10.5 | 10.5 | 10.5 | 10.5 | 10.5 | 10.5 | 10.5 | | 10.5 | 10.5 |
| FX 661 | 12 | 12 | 12 | 12 | | | | | | | | | 12 | | |
| SR-400 | | | | | | | | | | | | | | | |
| Sulfonated Novolak resin 40% | | | | | 1.5 | 1.5 | 1.5 | 1.5 | | | | | | 1.5 | |
| Sulfamic acid | 2 | | | | 2 | | | | 2 | | | | | | |
| Magnesium sulfate | 3 | | | | 3 | | | | 3 | | | | | | |
| Tanacid PC | | 2 | | | | 2 | | | | 2 | | | | | |
| Magnaflo II | | 3 | | | | 3 | | | | 3 | | | | | |
| Product A | | | 4 | | | | 4 | | | | 4 | | | | |
| Product B | | | | 4 | | | | 4 | | | | 4 | | | |
| Product C | | | | | | | | | | | | | 3.5 | 3.5 | 3.5 |
| Final pH of the padding bath | 2.1 | 2.1 | 2.2 | 2.2 | 2.1 | 2.1 | 2.2 | 2.2 | 1.9 | 1.9 | 2.0 | 2.0 | 2.0 | 2.0 | 1.9 |

TABLE #2

| FORMULATION | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| Stain test | 7–8 | 7–8 | 7–8 | 7–8 | 7–8 | 7–8 | 7–8 | 7–8 | 7–8 | 7–8 | 8 | 8 | 7–8 | 8 | 8 |
| Light fastness | 4 | 3 | 4–5 | 4–5 | 4 | 3 | 4–5 | 4–5 | 4 | 3 | 4–5 | 4–5 | 4–5 | 4–5 | 4–5 |
| Stain test after one wash | 3 | 3–4 | 5 | 5 | 4 | 5 | 6 | 6 | 4 | 5 | 6 | 6 | 4 | 6 | 6–7 |

The results on Table 2 show that by applying different additives the results of the stain resist, the light fastness and the durability to wash behaves differently It is clear that by using Product A, B or C, better light fastness is obtained, in addition to superior stain resistance and durability to wash.

Also it was observed that complete non-yellowing of the fiber and better whiteness is obtained by using Product A, B or C.

The above formulations show the importance of having the Product A, B or C in the solution of stain blocker to optimize the performance and the durability.

Example #2

The following stain blocker formulations set out in Table 3 were applied to untreated white polyamide (Nylon 66) carpet samples using the padding method explained hereinbefore; and Table 4 shows the test results.

In Table 4 the formulations 13 to 30 shows that Products A, B and C improve the light fastness and the durability to wash in addition to the improvement in stain resistance after washing.

It is believed that the Products A, B or C in combination with stain blocker will change many conventional methods in the industry and will overcome the light fastness and the yellowing problems of nylon fibers. In addition these products provide improvement of the stain resistance itself and the wash durability, and also the handling of the product.

Example #3

Table 5 shows different formulations of the invention employing a stain blocker available from Dupont under the Trade Mark SR400.

Results are shown in Table 6.

TABLE #3

| Fomulations g/L | 13 | 14 | 15 | 16 | 17 | 18 | 19 | 20 | 21 | 22 | 23 | 24 | 25 | 26 | 27 | 28 | 29 | Nylon 66 30 |
|---|---|---|---|---|---|---|---|---|---|---|---|---|---|---|---|---|---|---|
| Sulfonated Resol Resin 60% | | | | | | | | | | | | 0.5 | 0.5 | 0.5 | 0.5 | | 0.5 | |
| Methylmethacrylate copolymer higher stain 40000 mw | | | | | | | | | | | | 4.5 | 4.5 | 4.5 | 4.5 | | 4.5 | |
| FX 661 3M stain blocker | | | | | | | | 5 | 5 | 5 | 5 | | | | | 10 | | |
| SR-400 DuPont stain blocker | 10 | 10 | 10 | 10 | 5 | 10 | 5 | | | | | | | | | 10 | | |
| Sulfamic acid | 3 | 3 | | | | | | 3 | | | | 3 | | | | | | |
| Magnesium sulfate Epsom Salt | | 3 | | | | | | 3 | | | | | | | | | | |
| Tanacid | | | 3 | | | | | | 3 | | | | 3 | | | | | |
| Magnaflo II | | | 3 | | | | | | 3 | | | | 3 | | | | | |
| Product A | | | | 4 | 4 | | | | | 4 | | | | 4 | | | | |
| Product B | | | | | | 4 | 4 | | | | 4 | | | | 4 | | | |
| Product C | | | | | | | | | | | | | | | | 4.0 | 3.5 | 3.5 |
| Final pH of the padding bath | 1.9 | 1.9 | 1.9 | 2.1 | 2.0 | 2.1 | 2.0 | 1.85 | 1.85 | 2.0 | 2.0 | 1.85 | 1.85 | 2.0 | 2.0 | 1.9 | 1.95 | 1.9 |

TABLE #4

| Formulations | 13 | 14 | 15 | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|---|---|---|
| Stain test | 7–8 | 7–8 | 7–8 | 7–8 | 7–8 | 7–8 | 7–8 | 7–8 | 7–8 | 7–8 | 7–8 | 7–8 | 7–8 | 7–8 | 7–8 | 8 | 8 | 8 |
| Light fastness | 3–4 | 34 | 3 | 4–5 | 4–5 | 4–5 | 4–5 | 4 | 3 | 4 | 4 | 4 | 34 | 4–5 | 4–5 | 4 | 4 | 4–5 |
| Stain test after one wash | 4 | 4 | 5 | 5–6 | 4–5 | 5–6 | 4 | 4 | 4–5 | 5 | 5 | 5–6 | 5–6 | 6–7 | 6–7 | 5 | 6 | 6 |

TABLE #5

| Fomulations g/L | 28 | 29 | 30 | 31 | 32 | 33 | 34 | 35 | 36 | 37 | 38 | 39 | 40 |
|---|---|---|---|---|---|---|---|---|---|---|---|---|---|
| SR-400 | 12 | 12 | 12 | 12 | 12 | 12 | 6 | 6 | 12 | 6 | 12 | 6 | 6 |
| Sulfamic acid | 3 | 3 | | | | | | | | | | | |
| Magnesium sulfate | | 3 | | | | | | | | | | | |
| Epsom Salt | | | | | | | | | | | | | |
| Tanacid | | | 3 | 3 | | | | | | | | | |
| Magnaflo II | | | | 3 | | | | | | | | | 3 |
| Product A | | | | | 4 | 6 | 6 | | | | | | |
| Product B | | | | | | | | 4 | 6 | 6 | | | |
| Product C | | | | | | | | | | | 4.0 | 4.0 | |
| pH of the padding bath | 1.9 | 1.85 | 1.9 | 1.85 | 2.0 | 1.9 | 1.85 | 2.0 | 1.9 | 1.85 | 1.9 | 1.9 | 1.95 |

TABLE #6

| Formulations | 28 | 29 | 30 | 31 | 32 | 33 | 34 | 35 | 36 | 37 | 38 | 39 | 40 |
|---|---|---|---|---|---|---|---|---|---|---|---|---|---|
| Stain test | 8 | 8 | 8 | 8 | 8 | 8 | 7–8 | 7–8 | 8 | 7–8 | 8 | 8 | 8 |
| Lightfastness | 3–4 | 3–4 | 3 | 3 | 4 | 4–5 | 4–5 | 4–5 | 4–5 | 4–5 | 4–5 | 4–5 | 3 |
| Stain test after one wash | 4 | 4–5 | 4 | 4–5 | 4–5 | 5 | 3 | 3 | 5 | 3–4 | 5 | 4 | 3–4 |

By means of the invention it is possible to obtain treated dyed fibrous polyamide or wool substrate, especially carpets, having a stain resistance of at least 5, typically at least 7 on a scale of 1 to 8, a light fastness as determined by non-yellowing of at least 5, typically at least 7 on a scale of 1 to 8, a light fastness as determined by non-yellowing of at least 4 on a scale of 1 to 5, by the first staining test and the light fastness test described hereinbefore. Furthermore, the stain resistance of at least 5 is maintained after 1 to 5 washings of the substrate, demonstrating the durability or wash fastness of the stain resistance provided by the invention.

In this Specification % and ratios are by weight unless otherwise indicated.

We claim:

1. A fibrous substrate having stain resistance, light fastness and wash fastness comprising:

a fibrous polyamide or wool substrate bearing a formulation comprising:

(i) a resin selected from a water soluble sulfonated aromatic-aldehyde condensation resin, a hydrolyzed aromatic-containing vinyl ether maleic anhydride copolymer or a half ester of an aromatic-containing vinyl ether maleic anhydride copolymer, and (ii) a mixture of at least one acid selected from phosphoric acid, polyphosphoric acid, citric acid, or sulfuric acid and at least one metal compound selected from the group consisting of magnesium salts, magnesium hydroxide, magnesium oxide, copper salts, copper hydroxide and copper oxide in an aqueous vehicle.

2. A fibrous substrate according to claim 1, wherein said resin is a sulfonated resol resin.

3. A fibrous substrate according to claim 1, wherein said resin is a sulfonated novolak resin.

4. A fibrous substrate according to claim 1, wherein said resin is a condensation product of an aldehyde with dihydroxydiphenyl sulfone and naphthalene sulfonic acid.

5. A fibrous substrate according to claim 1, wherein ii) is a mixture of said acid and one or more metal compounds from:

magnesium phosphate,
magnesium citrate,
magnesium lactate,
magnesium carbonate,
magnesium sulfate,
magnesium silico fluoride,
magnesium hydroxide,
magnesium oxide,
copper phosphate,
copper sulfate,
copper carbonate,
copper hydroxide,
copper lactate,
copper acetate,
copper silico fluoride,
copper hydroxide or
copper oxide.

6. A fibrous substrate according to claim 1, wherein said formulation further comprises:

iii) a polymeric methacrylic acid.

7. A fibrous substrate according to claim 6, wherein said substrate is nylon 66, component i) is present in an amount of at least 0.01 weight percent, component ii) is present in an amount of at least 0.01 weight percent and component iii) is present in an amount of at least 0.06 weight percent, based on the weight of the substrate.

8. A fibrous substrate according to claim 6, wherein said substrate is nylon 6, component i) is present in an amount of at least 0.02 weight percent, component ii) is present in an amount of at least 0.1 weight percent and component iii) is present in an amount of at least 0.12 weight percent.

9. A fibrous substrate according to claim 1, wherein said substrate is wool, component i) is present in an amount of at least 0.02 weight percent and component ii) is present in an amount of at least 0.1 weight percent, based on the weight of the substrate.

10. A process for imparting stain resistance, light fastness and wash fastness to a fibrous substrate comprising:

(a) contacting a fibrous polyamide or wool substrate with i) a resin selected from a water soluble sulfonated aromatic-aldehyde condensation product, a hydrolyzed aromatic-containing vinyl ether maleic anhydride copolymer or a half ester of an aromatic-containing vinyl ether maleic anhydride copolymer, and ii) a mixture of at least one acid selected from phosphoric acid, polyphosphoric acid citric acid or sulfuric acid and at least one metal compound selected from the group consisting of magnesium salts and copper salts, in an aqueous vehicle, (b) allowing components i) and ii) to transfer from said aqueous vehicle to said substrate, and (c) drying said substrate.

11. A process according to claim 10, wherein said aqueous vehicle in step (a) further included:

iii) polymeric methacrylic acid.

12. A process according to claim 11, wherein said substrate is a nylon 6 or nylon 66 carpet.

13. A process according to claim 10, wherein said substrate is a wool carpet.

14. A process according to claim 10, wherein said resin is a sulfonated aromatic-aldehyde condensation product selected from a sulfonated resol resin, a sulfonated novolak resin or a condensation of an aldehyde with dihydroxydiphenyl sulfone and naphthalene sulfonic acid.

15. A formulation for enhancing stain resistance, light fastness and wash fastness in a fibrous polyamide or wool substrate comprising:

i) a resin selected from a water soluble sulfonated aromatic-aldehyde condensation resin, a hydrolyzed aromatic-containing vinyl ether maleic anhydride copolymer or a half ester of an aromatic-containing vinyl ether maleic anhydride copolymer, and ii) a mixture of at least one acid selected from phosphoric acid, polyphosphoric acid, citric acid or sulfuric acid and at least one metal compound selected from the group consisting of magnesium salts, magnesium hydroxide, magnesium oxide, copper salts, copper hydroxide and copper oxide, in a vehicle.

16. A formulation according to claim 15, further including:

iii) polymeric methacrylic acid.

17. A formulation according to claim 15, wherein said vehicle is aqueous.

18. A formulation according to claim 15, wherein said vehicle is a resist printing past containing sulfonated aromatic aldehyde condensation product.

19. A formulation according to claim 15, wherein said resin is a sulfonated aromatic-aldehyde condensation product selected from a sulfonated resol resin, a sulfonated novolak resin or a condensation of an aldehyde with dihydroxydiphenyl sulfone and naphthalene sulfonic acid.

20. A formulation according to claim 19, wherein component ii) is a mixture of said at least one acid and a metal compound selected from:

magnesium phosphate,
magnesium citrate,
magnesium lactate,
magnesium carbonate,
magnesium sulfate,
magnesium silico fluoride,
magnesium hydroxide,
magnesium oxide,
copper phosphate,
copper sulfate,
copper carbonate,
copper hydroxide,
copper lactate,
copper acetate,
copper silico fluoride,
copper hydroxide or
copper oxide.

* * * * *